US006017626A

United States Patent [19]

Hildreth

[11] Patent Number: 6,017,626

[45] Date of Patent: Jan. 25, 2000

[54] AUTOMOTIVE-WIRE INSULATION

[75] Inventor: Nelson Hildreth, Colchester, Vt.

[73] Assignee: Champlain Cable Corporation, Colchester, Vt.

[21] Appl. No.: 09/078,754

[22] Filed: May 14, 1998

[51] Int. Cl.[7] ..... H01B 7/34

[52] U.S. Cl. ..... 428/373; 428/374; 174/107; 174/109

[58] Field of Search ..... 174/107, 109; 428/373, 374

[56] References Cited

U.S. PATENT DOCUMENTS 5,473,113 12/1995 Aldissi ..... 174/36

*Primary Examiner*—Richard Weisberger

*Attorney, Agent, or Firm*—Salzman & Levy

[57] ABSTRACT

The present invention features a high-temperature, automotive-wire article having a thin wall construction and an operative temperature of at least 135 degrees Centigrade. The wire article is made of an inner core of copper that is surrounded by a single layer of insulation, the latter of which includes an integral composite of two insulations. The inner layer of the composite consists of a fluorocarbon material; the outer layer of the composite is made of an irradiated, cross-linked polyolefin material. The outer layer may be irradiation cross-linked with between approximately 60 to 400 kGy, and preferably between 100 and 200 kGy. The inner and outer layers can optionally be adhesively bonded together or thermal fused together using a meltable resin, in order to form a single layer. The total wall thickness of the composite is less than approximately 0.5 mm.

21 Claims, 1 Drawing Sheet

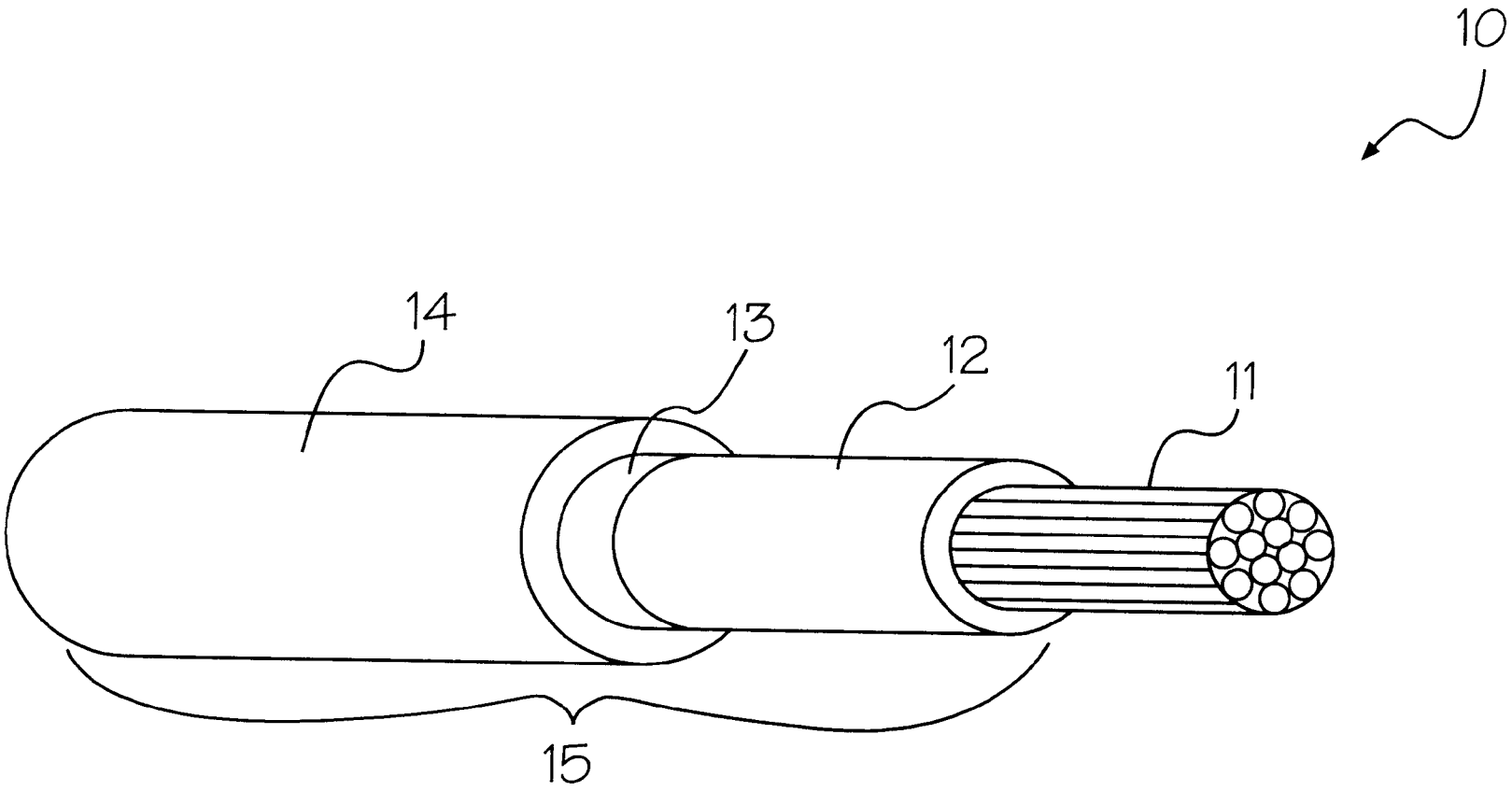
The Figure

AUTOMOTIVE-WIRE INSULATION

FIELD OF THE INVENTION:

The invention pertains to an automotive-wire article and, more particularly, to a high temperature, automotive-wire article that is operative in a temperature range of between approximately 135° C. and 180° C., and has an integrated, dual, thin-wall insulation composite less than approximately 0.5 mm.

BACKGROUND OF THE INVENTION

Automotive wire located under the hood in the engine compartment (engine wire) has traditionally been insulated with a single layer of high-temperature insulation that is disposed over an uncoated copper-wire core. The U.S. specification that is usually used for this wire is SAE J1128, rev. January 1995 type TXL. The high temperature requirements for type TXL insulation, which require specific tensile and elongation standards as well, specifies that the insulation be oven aged without the conductor at 155° C. for 168 hours.

For certain newer automobiles, the high temperature specified for type TXL insulation is not sufficient to cover the actual high temperatures existing in automobile engine compartments. The new requirements for engine wire range from135° C. to 180° C. A typical test procedure now required is aging the insulation with the conductor for 3,000 hours at 150° C. as specified in International Standard ISO 6722-1 and 6722-2, rev. January 1996.

Most of the high-temperature wire used as engine wire in North America uses cross-linked polyethylenes (XLPE) as the insulation material. European manufacturers have obtained good high-temperature performance (3,000 hrs. at 155° C.) using thermoplastic polyesters. This insulation has outstanding resistance to gas and oil, is mechanically tough, and resists copper catalyzed degradation. Thermoplastic polyesters, however, can prematurely fail, because of hydrolysis. Thermoplastic polyester insulated wires have also been found to crack when exposed to hot salty water. Thermoplastic polyesters have also failed temperature humidity cycling as specified in the United States Car Specification PF-9600, Change A. As a result of these weaknesses, the use of thermoplastic polyester insulation has been limited to uses other than under-the-hood applications in North America.

The XLPE insulation, on the other hand, has most of the desired properties of the polyester materials, in addition to possessing good resistance to water. However, this material degrades when it comes into contact with copper at high temperatures.

It is possible to tin coat the copper core in order to prevent the copper from contacting the XLPE, but the additional cost of tin and the tin coating process are expensive. In addition, most automotive specifications require that the copper core be uncoated.

It is also possible to add copper stabilizers to the polyethylene compound, but copper stabilizers (such as Ciba Geigy Irgonax MD-1024) yield only partial protection for wire having thin wall thicknesses, when used at 150° C.

The amount of wiring in automobiles has increased exponentially, as more electronics are being used in modern vehicles. This dramatic increase in wiring has motivated automobile manufacturers to reduce overall wire diameter by specifying thinner wall thicknesses, and specifying smaller conductor sizes. The forthcoming ISO 6722-5 specification (referred to as ultra-thin wire) reduces the insulation wall thickness to 0.20 mm. One automobile manufacturer in North America has released a new specification requiring a 0.15 mm wall thickness.

These reductions in insulation wall thicknesses pose manufacturing difficulties for wire fabricators. For XLPE, the thinner wall thickness of the insulation results in shorter thermal life, when aged at oven temperatures between 150° C. and 180° C. This limits their thermal rating. For example, a copper wire with an XLPE insulation having a 0.75 mm wall thickness is flexible, and does not crack when bent around a mandrel after being exposed to 150° C. for 3,000 hours. But this same copper wire, with the same XLPE insulation having a 0.25 mm wall thickness, becomes brittle after being exposed to 150° C. for 3,000 hours.

The deleterious effects created by these extremely thin wall requirements have been attributed to copper catalyzed degradation, which is widely recognized as a problem in the industry.

The present invention reflects the discovery that the desired performance of the insulation can be achieved by utilizing an integrated composite of insulation layers, rather than a single layer. The composite comprises an inner layer of fluorocarbon polymer and an outer layer of cross-linked polyethylene material. The inner layer of fluorocarbon polymer is designed to resist copper catalyzed degradation, while the outer layer of cross-linked polyolefin material is designed to be chemically resistant to automotive fluids and salt water, as well as to resist high temperatures. The outer layer is also designed to provide the required mechanical protection. This composite insulation makes the wire suitable for under-the-hood automotive applications.

Other high temperature polymers can be used as an inner layer to prevent copper migration into the XLPE. Such high temperature polymer can be selected from a group consisting of: polyether sulfone, poly-ether-ketone, polyetherimide, and thermoplastic polyester. These polymers can be used in place of a fluorocarbon polymer. A third optional adhesive layer could form the composite to bond the inner and outer polymer layers.

Considering that current automotive specifications call for only one layer, a manufacturer would not be inclined to combine several layers, nor have an expectation of obtaining the desired characteristics by employing several layers. The XLPE outer layer can be chemically cross-linked or can be cross-linked by irradiation processing. The irradiation process of cross-linking the polyethylene suggests that certain fluorocarbon homopolymers made from monomers such tetrafluoroethylene and hexafluoro-propylene should not be used. This is because their properties are adversely affected by irradiation. However, fluorocarbon copolymers such as ethylene-tetrafluoroethylene can be irradiation cross-linked with a reactive monomer, such as triallyl isocyanurate. The triallyl isocyanurate increases the high temperature capability.

SUMMARY OF THE INVENTION

In accordance with the present invention, there is provided a high-temperature, automotive-wire article having a thin wall construction and an operative temperature that is greater than 135 degrees Centigrade. The wire article comprises an inner core of copper that is surrounded by a polymer insulation, the latter including an integral composite of two compounds. The inner layer of the composite comprises a fluorocarbon material and the outer layer of the composite comprises an irradiated, cross-linked polyolefin material. The outer layer can be cross-linked chemically or with irradiation. Irradiation cross-linking requires a dose of approximately 60 to 400 kGy, and preferably between 100 and 200 kGy. The inner and outer layers can either be bonded together with the use of an adhesive, or thermally fused together to form an integral insulation. This integral insulation can readily be removed from the conductor with commercially available equipment. The total wall thickness of the composite is generally less than 0.5 mm, and usually between approximately 0.15 mm. and 0.41 mm. The inner, fluorocarbon layer is preferably made of a fluorocarbon polymer that contains $CH_2$ groups as part of the polymer chain. The inner layer has a thickness in the range of between approximately 0.025 mm and 0.13 mm, and preferably less than 0.1 mm.

BRIEF DESCRIPTION OF THE DRAWING

A complete understanding of the present invention may be obtained by reference to the accompanying drawing, when considered in conjunction with the subsequent detailed description, in which THE FIGURE illustrates a perspective view of the high-temperature, automotive-wire article of this invention.

DESCRIPTION OF THE PREFERRED EMBODIMENT

Generally speaking, the invention features a high-temperature, automotive-wire article formed of two insulation layers disposed over a copper wire core. The two insulation layers form a single integral layer. In order to meet automotive industry requirements, this composite insulation has a total wall thickness of less than approximately 0.5 mm.

Referring to THE FIGURE, a high-temperature wire article 10 of this invention is illustrated. The automotive-wire article 10 typically includes an electrically conductive core 11 of bare copper strands. The core 11 is covered with a composite insulation layer 15. This composite insulation layer 15 comprises a first, inner layer 12 and a second, outer layer 14. The first and second layers 12 and 14, respectively, can optionally be bonded together by a high-temperature, adhesive, intermediate layer 13. The integration of the inner and outer layers 12 and 14, respectively, allows both layers to act as a single layer. Therefore, when the wire article 10 is bent around terminals (not shown), the insulation does not wrinkle. An adhesive layer 13 may be added between the two insulation components 12 and 14 to obtain a satisfactory bond so that both layers can readily be removed from the conductor 11.

The typical insulation composite 15 of the automotive wire article 10 of this invention has an operative temperature range of between approximately 135° C. and 180° C.

The first, inner layer 12 comprises a fluorocarbon polymer. The preferred fluorocarbon is typically made of a fluorocarbon polymer that contains $CH_2$ groups as part of the polymer chain. The inner layer may also be selected from a group of materials consisting of polyether sulfone, polyether-ketone, polyetherimide, thermoplastic polyesters, and mixtures thereof. The inner layer must be resistant to copper poisoning and/or act as a barrier to prevent the copper from migrating into contact with an XLPE. The second, outer layer 14 comprises an XLPE insulation, preferably an irradiated, cross-linked polyethylene that has been irradiated with between approximately 60 to 400 kGy, and preferably between 100 and 200 kGy. The polyolefin can be selected from a group consisting of polyethylene, co-polymers, terpolymer of polyethylene, or blends of different polyethylenes or polyolefins.

The composite insulation 15 is generally less than approximately 0.5 mm in thickness. The inner layer 12 has a thickness in the range of between approximately 0.025 mm and 0.13 mm, preferably less than 0.1 mm. The outer layer 14 has a thickness less than approximately 16 mils. The optional, intermediate layer 13 is less than 0.025 mm thick.

EXAMPLE

The wire article 10 comprises a conductive core 11 with a cross sectional area of 0.5 $mm^2$ (seven strands of 0.08 $mm^2$) bare copper that is surrounded by a composite insulation having two insulative layers, including an inner layer 12 and an outer layer 14. The inner layer 12 is a terpolymer composed of tetrafluoroethylene, hexafluoropropylene and vinylidene fluoride which is commercially available from Dyneon LLC in Oakdale, Minn., under the tradename Dyneon THV 200G. The thickness of the inner layer 12 is 0.076 mm, which is extruded onto the wire core using standard tube extrusion techniques readily known in the industry. The outer layer 14 is 0.41 mm thick and comprises a cross-linked polyethylene that has been irradiated with approximately 150 kGy.

The wire article 10 has a typical operating temperature of between135° C. and 180° C. A comparison of the high temperature properties of the above wire with a standard XLPE insulation is shown below in Table I.

TABLE I

| Insulation Type | XLPE (mm) | XLPE (mm) | XLPE (mm) |
|---|---|---|---|
| Insulation Thickness | 0.41 | 0.25 | 0.41 |
| Inner Layer | None | None | Dytheon THV |
| Inner Layer Thickness | — | — | 0.0076 |
| Conductor (Copper) | Uncoated | Tin Coated | Uncoated |
| Oven Aging Resistance @ 180° C. | 18 Days | 20 Days | 25 Days |

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent presented in the subsequently appended claims.

What is claimed is:

1. A high-temperature, automotive-wire article that has an operative temperature exceeding that of at least 135° C., comprising:

an uncoated copper core;

an integrally bonded composite insulation disposed over said uncoated copper core comprising a fluorocarbon material forming an inner layer surrounding said copper core and a cross-linked polyethylene material forming an outer layer disposed over said inner layer, said integrally bonded composite insulation having a total wall thickness of less than approximately 0.5 mm and an operative temperature exceeding 135° C.

2. The high-temperature, automotive-wire article in accordance with claim 1, wherein said composite insulation further comprises an intermediate layer disposed between the inner and outer layers, said intermediate layer providing adhesion between said inner layer and said outer layer so as to form a single, integral composite of insulation.

3. The high-temperature, automotive-wire article in accordance with claim 2, wherein said intermediate layer is less than 0.08 mm thick.

4. The high-temperature, automotive-wire article in accordance with claim 1, wherein said polyolefin material is selected from a group consisting of high density polyethylene, metallocene-catalyzed polyolefins, other polyethylene co-polymers, and mixtures thereof.

5. The high-temperature, automotive-wire article in accordance with claim 1, wherein said fluorocarbon polymer material inner layer consists of a fluorocarbon polymer that contains $CH_2$ groups as part of a polymer chain.

6. The high-temperature, automotive-wire article in accordance with claim 1, wherein said fluorocarbon polymer material of said inner layer consists of a fluorocarbon polymer that contains a $CH_2$ group as part of a polymer chain and a triallyl isocycanurate monomer, and further wherein the fluorocarbon polymer and polyethylene compound is irradiation cross-linked.

7. The high-temperature, automotive-wire article in accordance with claim 1, wherein said inner layer is selected from a group consisting of: polyether sulfone, polyether-ketone, polyetherimide thermoplastic polyesters, and mixtures thereof.

8. The high-temperature, automotive-wire article in accordance with claim 1, wherein said composite insulation has a total wall thickness in a range of between approximately 0.15 mm and 0.41 mm.

9. A high-temperature, automotive-wire article that has an operative temperature exceeding 135° C., comprising:

a uncoated copper core;

an integrally bonded composite insulation disposed upon said uncoated copper core and comprising a fluorocarbon material forming an inner layer surrounding said copper core and a cross-linked polyethylene material forming an outer layer disposed over said inner layer and integrally bonded thereto by means of an intermediate layer, said integrally bonded composite insulation having a total wall thickness of less than approximately 0.5 mm and meeting the 3,000 hour aging test at 150° C., as specified in ISO-6722.

10. The high-temperature, automotive-wire article in accordance with claim 9, wherein said intermediate layer bonds said inner and outer layers into a single, integral composite of insulation.

11. The high-temperature, automotive-wire article in accordance with claim 10, wherein the intermediate layer bonding said inner and outer layers into a single, integral composite of insulation, comprises an adhesive.

12. The high-temperature, automotive-wire article in accordance with claim 9, wherein said intermediate layer comprises a thickness of approximately less than 0.08 mm.

13. The high-temperature, automotive-wire article in accordance with claim 9, wherein said polyethylene material is selected from a group consisting of: high density polyethylene, metallocenecatalyzed polyolefins, polyethylene co-polymers, and mixtures thereof.

14. The high-temperature, automotive-wire article in accordance with claim 9, wherein said inner layer material is selected from a group consisting of: polyether sulfone, polyetherketone, polyetherimide thermoplastic polyesters, and mixtures thereof.

15. The high-temperature, automotive-wire article in accordance with claim 9, wherein said composite insulation has a total wall thickness of less than approximately 0.5 mm.

16. A high-temperature, automotive-wire article that has an operative temperature exceeding 135° C., comprising:

a stranded, bare copper wire core;

an integrally bonded composite insulation comprising a fluorocarbon material forming an inner layer surrounding said copper core and a cross-linked polyethylene material forming an outer layer disposed over said inner layer with a composite insulation having a total wall thickness of less than approximately 0.5 mm and an operative temperature exceeding 135° C., said cross-linked polyolefin material having been irradiated with between approximately 60 to 400 kGy.

17. The high-temperature, automotive-wire article in accordance with claim 16, wherein said cross-linked polyolefin material is irradiated with between approximately 100 and 200 kGy.

18. The high-temperature, automotive-wire article in accordance with claim 16, wherein said polyethylene material is selected from a group consisting of high density polyethylene, metallocenecatalyzed polyolefins, polyethylene co-polymers, and mixtures thereof.

19. The high-temperature, automotive-wire article in accordance with claim 16, wherein said inner layer material is selected from a group consisting of: polyether sulfone, polyether-ketone, polyetherimide thermoplastic polyesters, and mixtures thereof.

20. The high-temperature, automotive-wire article in accordance with claim 16, wherein said composite insulation has a total wall thickness in a range of between approximately 0.15 mm and 0.41 mm.

21. The high-temperature, automotive-wire article in accordance with claim 16, wherein said cross-linked polyethylene material is preferably irradiated with between approximately 100 and 200 kGy.

* * * * *